US005990400A

United States Patent [19]

Hoshino

[11] Patent Number: 5,990,400

[45] **Date of Patent: *Nov. 23, 1999**

[54] CONNECTION BETWEEN THE PEDAL AND HEEL PLATES OF A FOOT PEDAL

[75] Inventor: Yoshihiro Hoshino, Nagoya, Japan

[73] Assignee: Hoshino Gakki Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/816,061

[22] Filed: Mar. 11, 1997

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS 2,132,211 10/1938 Hueckstead ..... 84/422.1

4,188,853 2/1980 Bills ..... 84/422.1

5,565,638 10/1996 Liao ..... 84/422.1

*Primary Examiner*—William M. Shoop, Jr.

*Assistant Examiner*—Shih-Yung Hsieh

*Attorney, Agent, or Firm*—Ostrolenk, Faber, Gerb & Soffen, LLP

[57] ABSTRACT

A connection between a pivotable pedal plate of a foot pedal for operating a drum, cymbal, or the like instrument and a relatively stationary heel plate. The pivot connection includes an axle that extends through flanges projecting rearwardly from the pedal plate and through a projection forwardly of the heel plate that extends into the recess between the flanges of the pedal plate. Screws hold the axle firmly to either the pedal plate or the heel plate and bearings in the other of the heel plate and the pedal plate receive the axle and permit relative motion between the other plate and the axle without any gap between the axle and either of the plates as would be usual in the prior art.

5 Claims, 7 Drawing Sheets

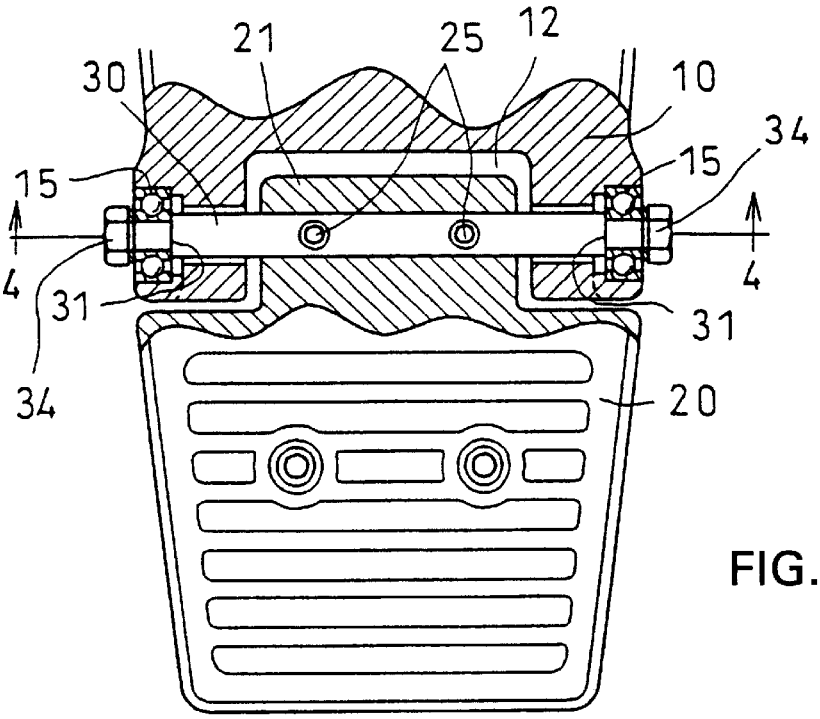
FIG. 3
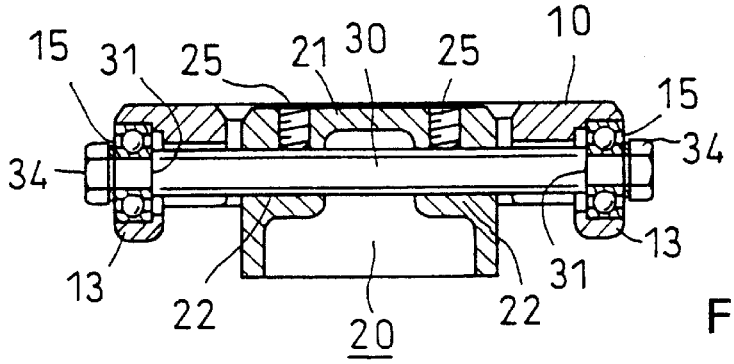
FIG. 4
FIG. 5
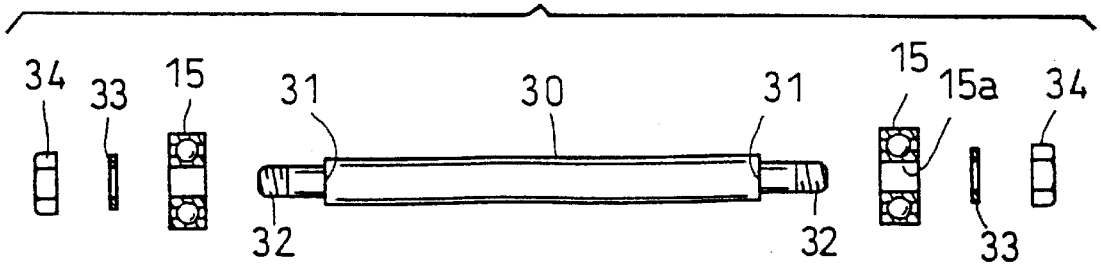

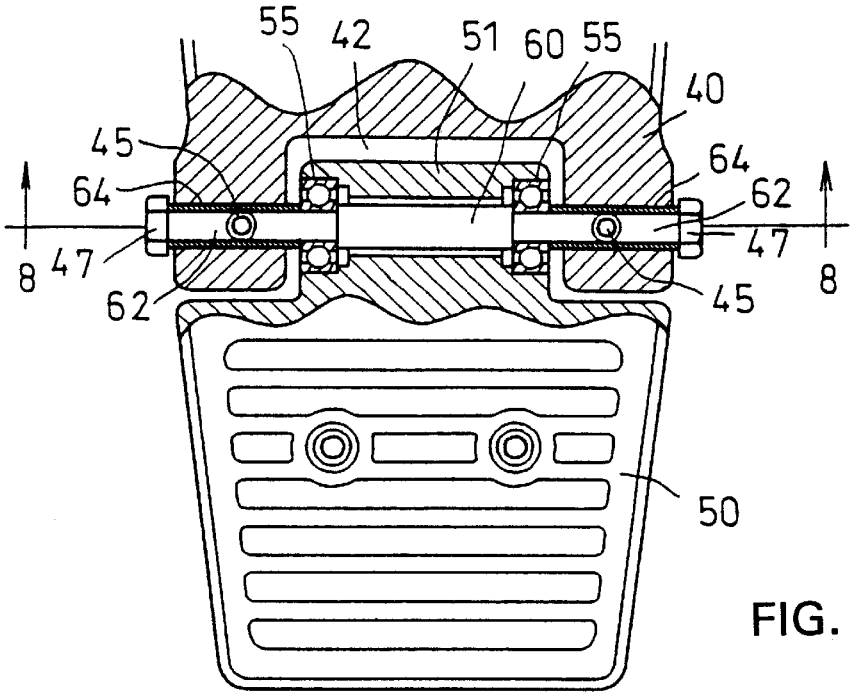
FIG. 7
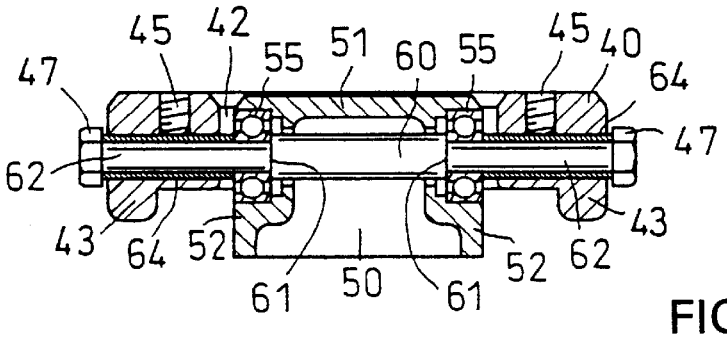
FIG. 8
FIG. 9
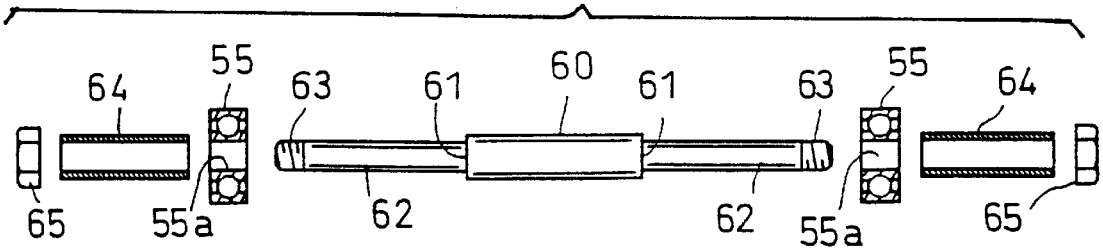

CONNECTION BETWEEN THE PEDAL AND HEEL PLATES OF A FOOT PEDAL

BACKGROUND OF THE INVENTION

The present invention relates to the connection between the pedal plate and the heel plate of a foot pedal for operating a drum, a cymbal, or the like instrument.

A conventional foot pedal for a musical instrument rotates a beater 121 to beat a drum, as shown in FIG. 11, or to raise or lower an operating rod for a high hat cymbal 130, as shown in FIG. 12.

A conventional pedal F shown in FIG. 10 comprises a pedal plate which operates the action part, i.e., the beater 121 or the operating rod 131, and a heel plate 110 that is connected to the rear of the plate 100. A link 101 connects the pedal plate to the action part.

The pedal plate 100 is movable while the heel plate 110 is stationary. They are connected at a pivot in a rotatable fashion at axle 105. This connection in the prior art includes a cut out concave 102 region formed at the rear of the pedal plate 100, a rotation axle 105 extending across the concave 102 and a convex part 111 extending forward from the heel plate and extending into the concave 102. A through hole 112 is provided across the convex part 111 at the axle 105 at the front of the heel plate 110. It is aligned with the holes at the sides of the concave 102 on axle 105. Nylon bushes 115 are provided between the axis 105 and the through hole 112, making the pedal plate freely pivotable.

In this conventional structure, the axle 105 is fixed to the pedal plate 100 but rotates inside the inner hole of the nylon bush 115 that has been installed on the heel plate 110 as the pedal plate 100 pivots. To reduce the friction resistance with the axle 105 during rotation, a gap S1 is formed in the inner hole of the nylon bush 115. In addition, a gap S2 for reducing friction resistance is required between the nylon bush 115 that has been installed on the heel plate 110 and the concave 102 of the pedal plate 100.

However, either gap S1 or S2 creates looseness or play in the pedal plate 100 during operation of the foot pedal, possibly causing noise or beating power loss during a performance. Some performers dislike this kind of looseness or play.

SUMMARY OF THE INVENTION

An object of the invention is to provide a connection between the pedal plate and the heel plate of a foot pedal with no need for a gap in the rotation connection between the pedal plate and the heel plate.

Another object is to reduce or eliminate looseness or play in the pedal plate during a performance, producing high operability qualities and providing a simple and compact mechanism.

The connection between the pedal plate and the heel plate of a foot pedal for operating a drum or a cymbal, etc., has an axle that connects the rear of the pedal plate and the front of the heel plate. The axle is fixed on the heel plate and is held by a bearing in the pedal plate. Alternatively, the axle is fixed on the pedal plate and is held by a bearing in the heel plate.

Other objects and features of the invention are explained below with reference to the drawings.

BRIEF DESCRIPTION OF THE DRAWINGS

FIG. 3 is an expanded partially cut section of a fragment of the pedal in FIG. 1;

FIG. 4 is a cross section along line 4—4 in FIG. 3;

FIG. 5 is a front view, exploded out, of parts of the pedal;

FIG. 7 is an expanded partially cut section of a fragment of the pedal of the other embodiment;

FIG. 8 is a cross section cut along line 8—8 in FIG. 7;

FIG. 9 is a front view, exploded out, of its parts.

DESCRIPTION OF THE PREFERRED EMBODIMENTS

Figure 1:
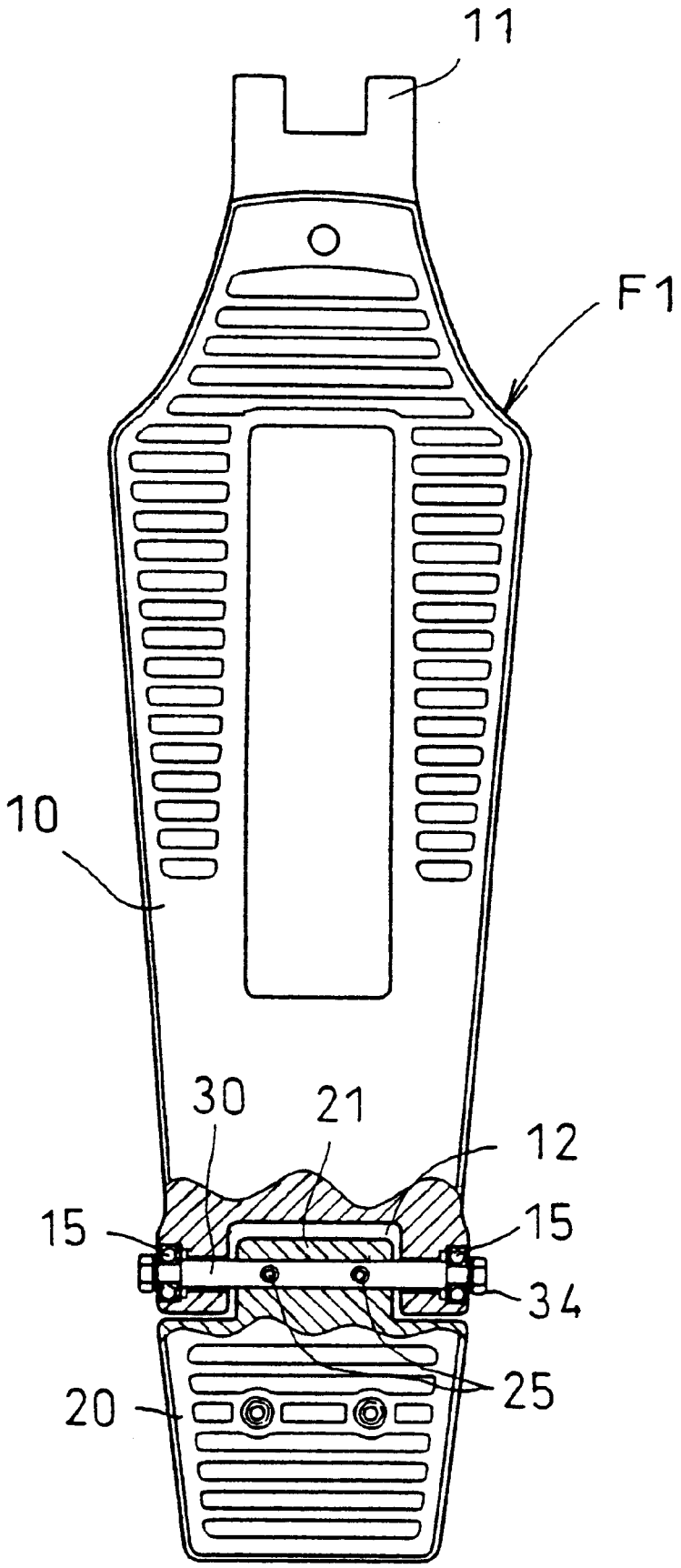
FIG. 1 is a plan view, partially in section, of an example of the pedal of the invention.
Figure 2:
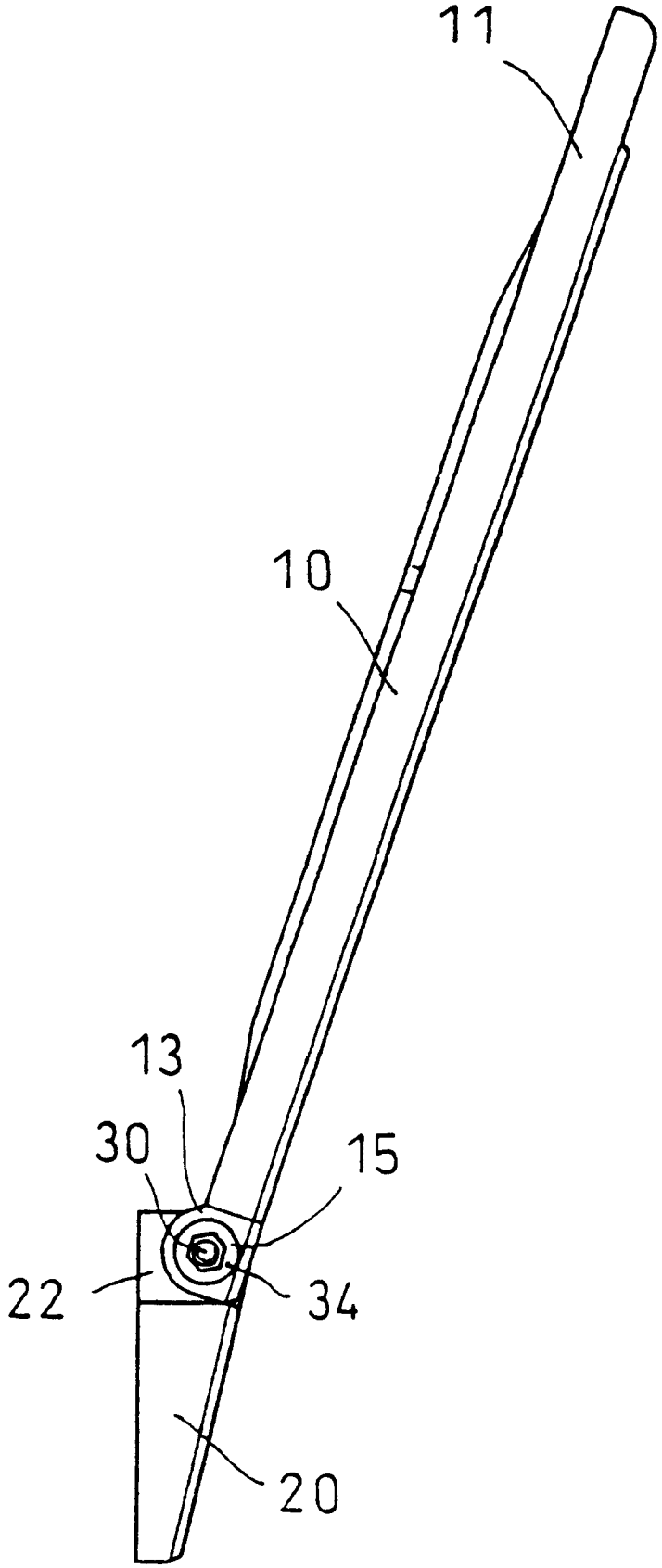
FIG. 2 is a side view of the pedal.
Figure 6:
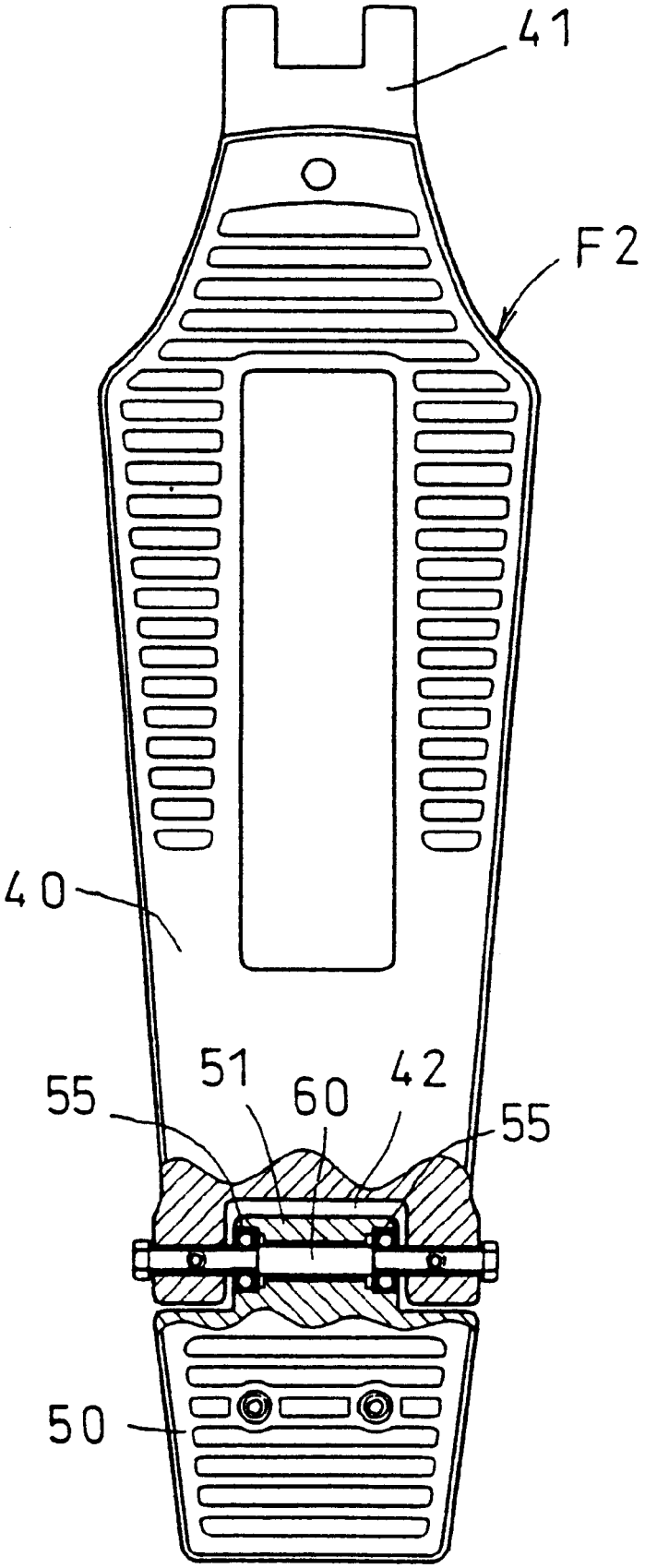
FIG. 6 is a plan view, partially in section, of another embodiment of the invention.
Figure 10:
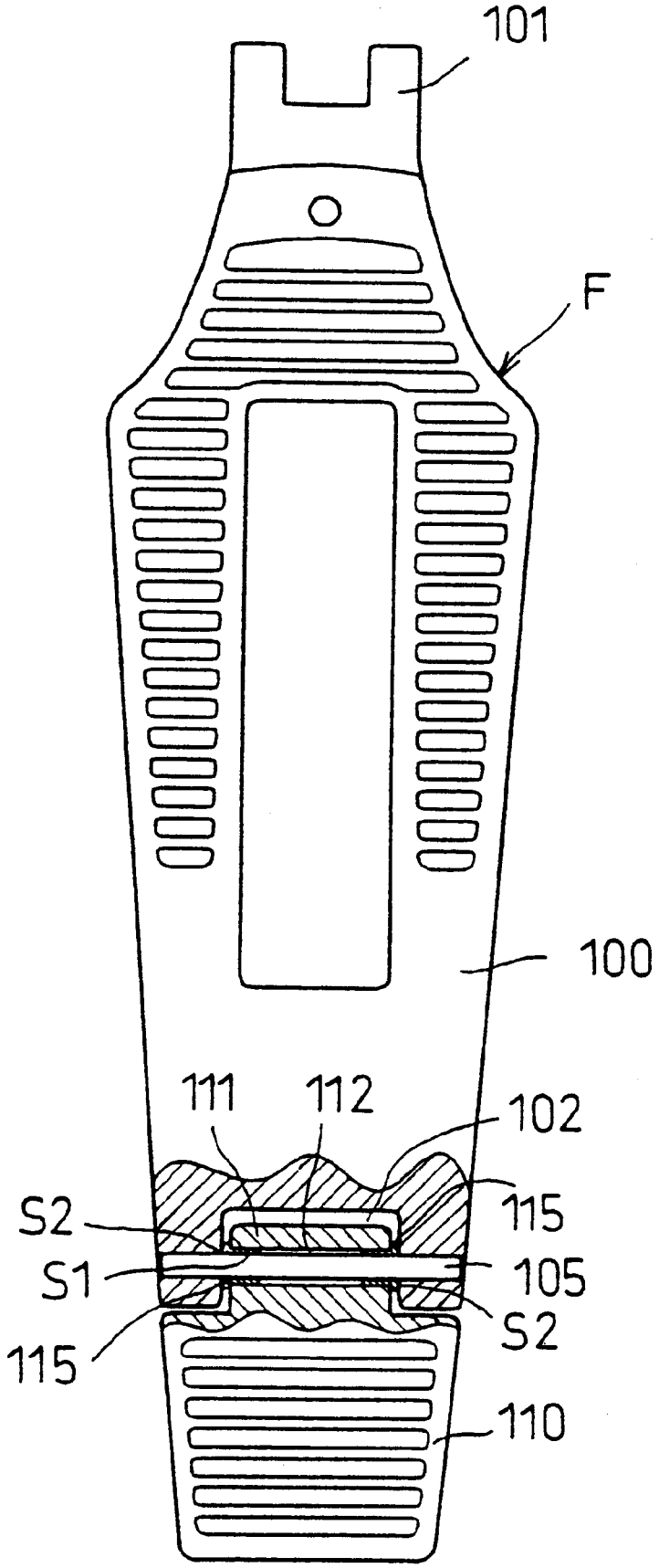
FIG. 10 is a plan view of a prior art connection between a pedal plate and a heel plate in a foot pedal.
Figure 11:
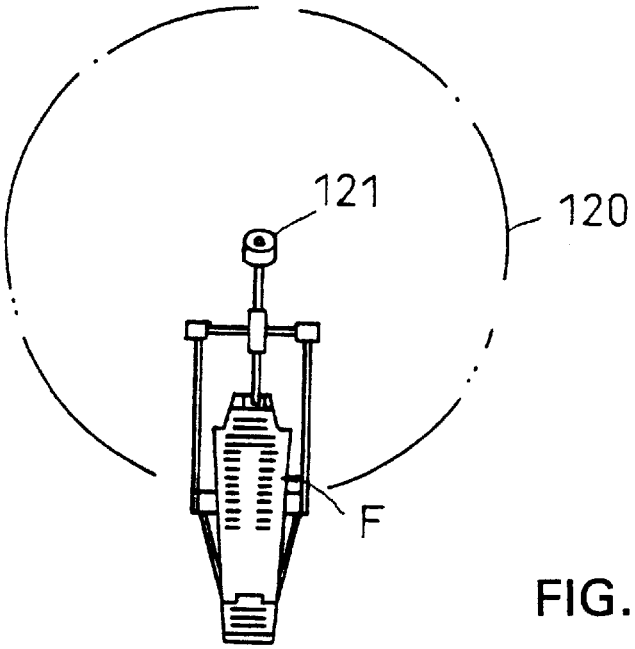
FIG. 11 is an oblique view of one example of the prior art foot pedal in use on a drum.
Figure 12:
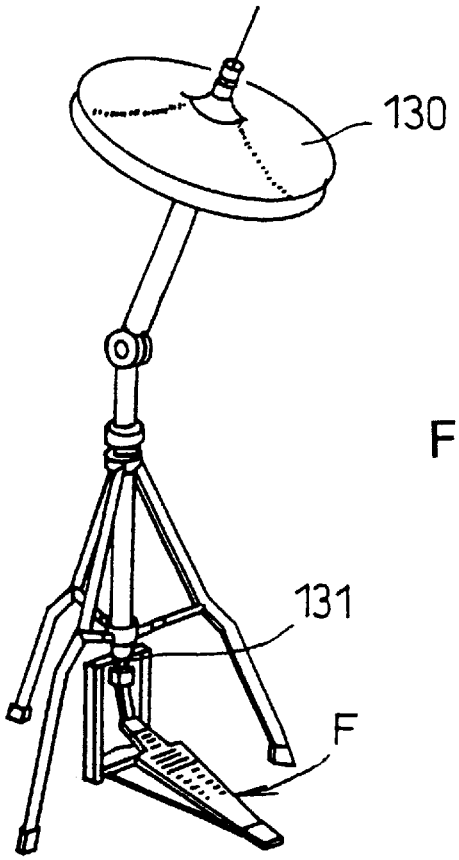
FIG. 12 is an oblique view of another example of use of the prior art foot pedal for a cymbal.

In the first embodiment shown in FIGS. 1–5, the foot pedal F1 includes a movable pedal plate 10 that operates the action part of a drum beater or the action rod for playing a musical instrument like a drum or a cymbal. The link or connection 11 from the pedal plate 10 to the action part is conventional, being connected to a driver, like a beater or cymbal support. The plate 10 is also connected to a stationary heel plate 20 to the rear of the plate 10 that serves as the landing part.

The movable pedal plate 10 and the stationary heel plate 20 are freely rotatably connected by an axle 30. A cut out concave 12 provided in the rear edge of the pedal plate 10 receives a convex projection 21 from the front edge of the heel plate 20. The rear part of the pedal plate 10 includes the concave 12 and includes flanges 13 at the sides of that plate which extend rearwardly and define the concave. The convex projection 21 from the heel plate 20 is shaped to fit into the concave 12 and between the flanges 13 of the pedal plate 10.

The axle 30 is fixed against rotation relative to the heel plate 20 by a fixing member such as a screw 25, preferably a stopping or set screw 25 that extends into the upper face of the heel plate 20. The axle also extends through the ball bearings 15 that are disposed in the flanges 13 located on both sides of the concave in the pedal plate 10, as seen in FIGS. 3 and 4. Thus, the axle 30 runs through the wall 22 at the lower part of the convex projection 21 of the heel plate 20 and is supported by the bearings 15 in the pedal plate 10 and the axle defines the inner race of each bearing.

The axle 30 has an axially central region of larger diameter and axially outer regions of the smaller diameter defined at a step between adjacent axial regions. To hold the axle 30 to the pedal plate 10, threads 32 are disposed on the smaller diameter steps 31 on both axial sides of the axle 30. The inner holes 15*a* of the bearings 15 are installed on the small diameter steps 31 which serve as the bearing inner rings. The bearings are followed on the steps 31 by washers 33 and respective tightening nuts 34 tightened onto the threads.

Since the axle 30 is fixed to the heel plate 20 by the fixing member 25 but is held to the pedal plate 10 in the bearing 15, the axle rotates at the bearing 15. There is no need to provide any gap between the pedal plate 10, the heel plate 20 and the axle 30. This avoids the possibility of creating looseness or play among these parts, as occurs in the conventional design.

Next, the second embodiment of the invention is described referring to FIGS. 6 through 9. In the connecting part of the foot pedal F2, the axle 60 is fixed to the pedal plate 40 rather than to the heel plate 50 and is held in bearings 55 that are provided in the heel plate 50 rather than in the pedal plate 40.

The link 41 connects the pedal plate 40 with the action part for playing a musical instrument. A concave cut out is formed at the rear of the pedal plate 40. A convex projection 51 projects from the heel plate 50 into the cut out concave 42.

As is shown in FIGS. 7 and 8, the axle 60 runs through the flanges 43 located on both sides of the cut out concave in the pedal plate 40. The axle is supported by the bearings 55 that are disposed inside the walls 52 at the lower part of the convex projection 51 of the heel plate 50.

Both end parts of the axle 60 are formed as small diameter parts 62 through steps 61. The end parts are supported in the bearing 55, as shown in FIG. 9. A collar 64 holds each bearing 55 in place by extending over each small diameter part 62. The spiral threaded ends 63 of the parts 62 receive respective tightening nuts 47.

The axle 60 is fixed to the pedal plate 40 by stopping screws 45 that extend into the face of the pedal plate 40, i.e., as shown in FIGS. 7 and 8. The axle 60 is also installed in the bearings 55 which are in the lower walls 52 of the heel plate 50, so that the small diameter parts 62 of the axle may be inserted into the bearing inner diameter parts 55*a*. The bearings engage the steps 61 to sandwich the bearings 55 between the steps and the collars 64 by means of the tightening nuts 47.

As the axle 60 is fixed to the pedal plate 40 by the fixing member 45, rotation of the axle occurs at the bearings 55, as described above. Therefore, no gap is required between the pedal plate 40, the heel plate 50 and the axle 60. Accordingly, the looseness or play that may be seen in the conventional design is not experienced.

The structure of the invention avoids a need for a gap in the relationship among the pedal plate, the heel plate and the axle. As a result, no looseness or play is produced, in contrast with a conventional design. Accordingly, noise is not generated nor does any power loss occur, as with the conventional design. Thus, the invention is suitable for performers who dislike looseness in the pedal operation.

In the invention, bearings may be provided either in the pedal plate or in the heel plate. As a result, the structure can be simple and the number of the parts can be small, producing a compact construction. Further, the performer can perform without any adverse feelings. The pedal plate is elongated with front and rear portions, and the heel plate has a front portion pivotally connected to the pedal plate's rear portion. As seen in FIG. 1, for example, the pedal plate has width transversely of its length where the maximum width of the pedal's rear portion is generally the same as the maximum width of the heel plate's front portion, so that the side edges of the adjacent plates define generally smooth lines. As seen in FIG. 1 the pedal plate tapers slightly in width from its front portion to its rear portion, and that taper is continued by the heel plate. Even where a plurality of pedals are provided, they can be brought close together without creating any hindrance. In this manner, the invention offers many advantages in actual use.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A foot pedal apparatus for operating a musical instrument, the foot pedal apparatus comprising:

an elongated pedal plate with front and rear portions and means at said front portion thereof for connection to the musical instrument, a stationary heel plate with a front portion, and a pivot coupling said pedal plate rear portion to said heel plate front portion and enabling the pedal plate to pivot relative to the heel plate, said rear portion of the pedal plate and said front portion of the heel plate having each a respective width that is generally the same, said pivot comprising an axle extending through at least one extension respectively of said rear portion of said pedal plate and said front portion of said heel plate, said axle having a central stem part adjacent opposite end parts and separated by a step, said axle being fixedly coupled to one of said extensions of said plates to preclude rotation of said axle relative to the plate to which it is fixedly coupled, and bearings secured in the other of said plates wherein the bearings are secured in the heel plate by collars passing through said extension of said other of said plates and sandwiching the bearings respectively between the steps on the axle and the collars.

2. Apparatus according to claim 1, wherein said central stem part of said axle extends through said rear portion of said pedal plate and is fixed from rotation therein, and said end parts of said axle are received in bearings which are secured in said front portion of the heel plate.

3. Apparatus according to claim 1, wherein the width of said pedal plate tapers slightly from its front portion to a smaller width at its rear portion, and said heel plate width continues said taper from its said front portion to its rear portion.

4. Apparatus according to claim 1, wherein each of said bearings comprises a bearing having outer and inner races, the outer race secured to said heel plate, and said axle being secured to said inner race.

5. Apparatus according to claim 1, wherein said pedal plate rear end has a pair of spaced apart legs extending rearward and defining a space therebetween, each said leg including a bore normal thereto for receiving said axle, and said heel plate projection comprises a tab extending forward into said space between said legs and having a bore normal thereto for receiving said axle.

* * * * *